US007331748B2

(12) United States Patent
Knepp et al.

(10) Patent No.: US 7,331,748 B2
(45) Date of Patent: Feb. 19, 2008

(54) ASSEMBLY FOR MOUNTING VARIOUS WORK TOOLS TO A CONSTRUCTION VEHICLE

(75) Inventors: Wayne A. Knepp, Morton, IL (US); Tim Wetterhus, Morton, IL (US); Kevin Potter, Washington, IL (US)

(73) Assignee: Morton Buildings, Morton, IL (US)

( * ) Notice: Subject to any disclaimer, the term of this patent is extended or adjusted under 35 U.S.C. 154(b) by 174 days.

(21) Appl. No.: 11/143,688

(22) Filed: Jun. 2, 2005

(65) Prior Publication Data

US 2006/0099062 A1 May 11, 2006

Related U.S. Application Data

(60) Provisional application No. 60/577,764, filed on Jun. 8, 2004.

(51) Int. Cl.
*E02F 9/00* (2006.01)

(52) U.S. Cl. ..... 414/686; 212/301; 280/763.1

(58) Field of Classification Search ..... 414/680, 414/685, 688, 686, 694; 212/301; 280/755, 280/760, 762, 763.1, 764.1, 765.1, 766.1
See application file for complete search history.

(56) References Cited

U.S. PATENT DOCUMENTS

| | | | | |
|---|---|---|---|---|
| 3,791,530 | A * | 2/1974 | Gorl et al. | 212/304 |
| 4,431,363 | A * | 2/1984 | Waite | 414/687 |
| 4,461,490 | A * | 7/1984 | Fritel et al. | 280/763.1 |
| 6,095,474 | A * | 8/2000 | Arnold | 248/352 |

* cited by examiner

*Primary Examiner*—Donald Underwood
(74) *Attorney, Agent, or Firm*—Howard & Howard Attorneys, P.C.

(57) ABSTRACT

An assembly for mounting various work tools, e.g., a backhoe, to a pair of parallel frame members (28) of a vehicle (20). A pair of parallel main beams (26) extend transversely across the frame members (28) and a telescoping stabilizing leg (24) extends downwardly from each end of each of the main beams (26). Four posts (48) extend from the main beams (26) for connecting the main beams (26) at spaced positions along the pair of parallel frame members (28). Each of the posts (48) is L-shaped in cross section with one flange thereof welded to the associated main beam (26) and the other flange attached to the vehicle (20) frame members (28). A pair of bearing blocks (50) are disposed on a first leg cross-beam (42) for pivotally supporting a and a pair of hydraulic cylinder-pistons (52) are attached to a main cross-beam (40) for pivoting the backhoe about the bearing blocks (50).

10 Claims, 4 Drawing Sheets

ASSEMBLY FOR MOUNTING VARIOUS WORK TOOLS TO A CONSTRUCTION VEHICLE

CROSS REFERENCE TO RELATED APPLICATION

This application claims the benefit of provisional application Ser. No. 60/577,764 filed Jun. 8, 2004.

BACKGROUND OF THE INVENTION

1. Field of the Invention

The subject invention relates to an assembly for mounting various work tools, such as a back hoe, to a construction vehicle having a pair of spaced and parallel frame members.

2. Description of the Prior Art

The prior art is replete with toll support and attachment assemblies that include a platform for supporting the tool and a plurality of stabilizing legs extending from the platform for engaging the ground to stabilize the platform as the tool is in operation. Normally, the vehicle is especially adapted to support and operate a particular tool. However, there are numerous utility vehicles utilized in the construction business that could be used to operate various tools.

SUMMARY OF THE INVENTION AND ADVANTAGES

The subject invention provides an assembly for mounting various work tools to utility vehicles of the type having the well known and used parallel frame members. The invention includes a platform and a plurality of stabilizing legs extending from the platform for engaging the ground. The assembly is distinguished by a pair of parallel and spaced connectors for connecting the platform at spaced positions along a pair of parallel frame members of a vehicle.

Accordingly, the platform may be attached horizontally to any number of utility vehicles having frame members for supporting a tool. The assembly is particularly suited for supporting a tool on the back of a truck or other vehicle having a truck-like chassis.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
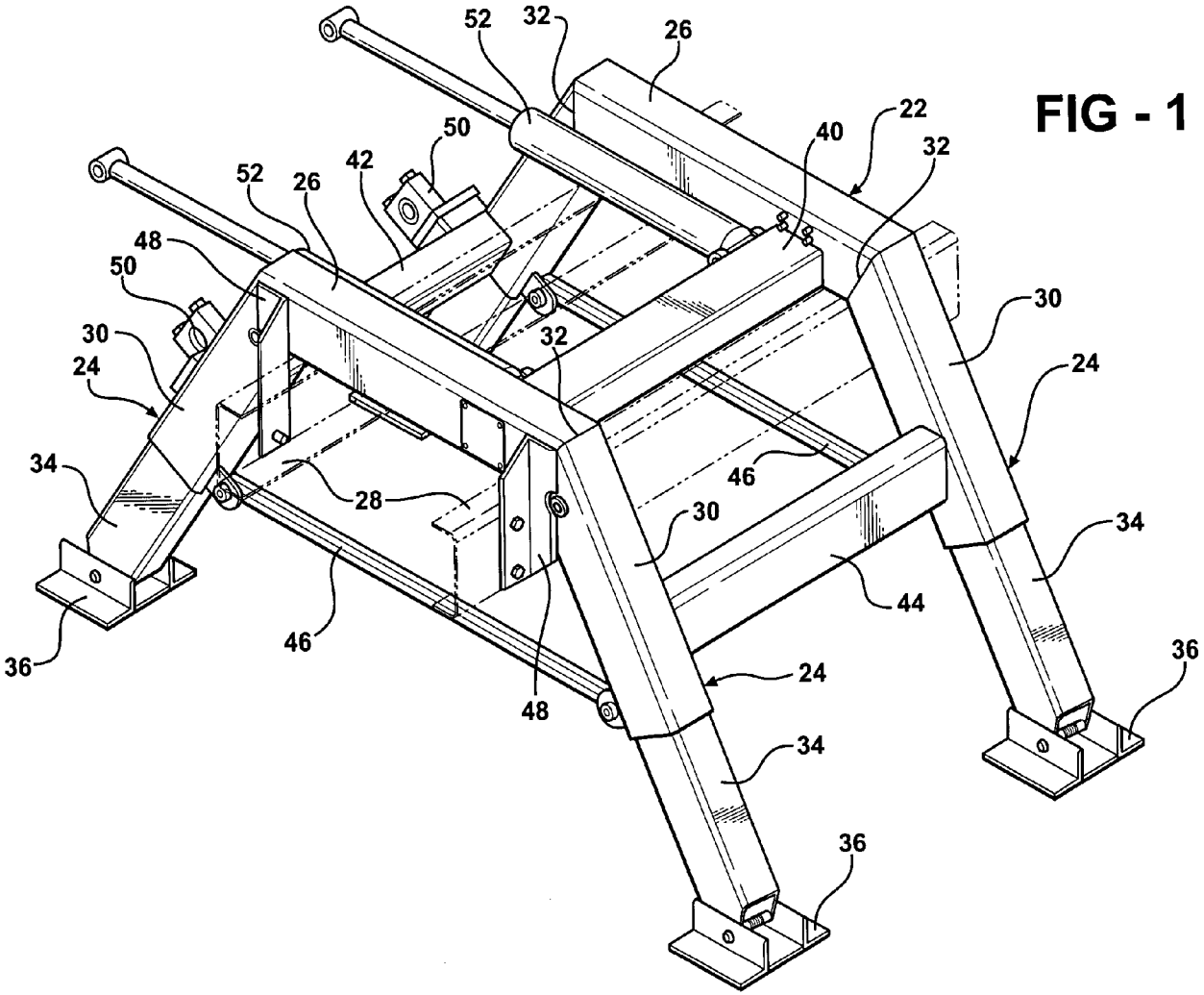
FIG. 1 is perspective view of the mounting assembly of the subject invention.

Referring to the Figures, an assembly for mounting various work tools to a construction vehicle 20 is shown throughout the views. The assembly includes a platform 22 and a plurality of stabilizing legs 24 extending from the platform 22 for engaging the ground to stabilize the platform 22.

The platform 22 includes a pair of main beams 26 disposed in spaced and parallel relationship to one another for extending transversely between ends and across a pair of parallel frame members 28 of the vehicle 20. One of the stabilizing legs 24 extends downwardly from each end of each of the main beams 26 with a pair of stabilizing legs 24 extending parallel to one another from opposite ends of the main beams 26. More specifically, a fixed length 30 of each stabilizing leg 24 extends downwardly from each end of each of the main beams 26 and diverges outwardly from opposite ends of the main beams 26. Accordingly, the pairs of stabilizing legs 24 at opposite ends of the main beams 26 diverge at an included acute angle from one another.

The main beams 26 and the fixed lengths 30 each comprise a hollow tube having a four sided cross section and each of the fixed lengths 30 is welded to an associated end of one of the main beams 26 at a mitred joint 32 therebetween.

A telescoping length 34 of each stabilizing leg 24 is slidably supported by the fixed length 30 and extends to a distal end, upon which a foot 36 is pivotally supported through a bolt for engaging the ground to stabilize the platform 22. A leg actuator 38, comprising a pneumatic, electric or hydraulic drive, is connected to each telescoping length 34 and extends into the associated fixed length 30 for moving each telescoping length 34 relative to the associated fixed length 30.

A main cross-beam 40 interconnects the main beams 26 adjacent one end thereof. A first leg cross-beam 42 extends transversely to and interconnects the fixed lengths 30 of a first pair of the stabilizing legs 24 below a first end of the main beams 26. The first leg cross-beam 42 has a four sided cross section with two parallel sides thereof being disposed parallel to the fixed lengths 30 attached thereto. In other words, the two parallel sides of the first leg cross-beam 42 are disposed at the same angle relative to the main beams 26 as the stabilizing legs. A second leg cross-beam 44 extends transversely to and interconnecting the fixed lengths 30 of the second pair of the stabilizing legs 24 below a second end of the main beams 26. The second leg cross-beam 44 has a four sided cross section with two parallel sides thereof being disposed parallel to the sides of the main beams 26. In other words, the two parallel sides of the second leg cross-beam 44 are generally perpendicular to the ground and at an acute angle to the diverging angle of the second pair of the stabilizing legs 24.

A cross tie 46 extends between diverging fixed lengths 30 of the stabilizing legs 24 at opposite ends of each of the main beams 26, for resisting diverging separation of the oppositely diverging stabilizing legs 24.

A pair of parallel and spaced connectors including at least four posts 48 connect the platform 22 at spaced positions along the vehicle 20 frame members 28. At least two of the posts 48 are disposed on each main beam 26 for attaching each main beam 26 to both of the frame members 28 The four posts 48 extend from the main beams 26 with one of the posts 48 disposed adjacent each of the mitred joints 32 for connecting the main beams 26 at spaced positions along the pair of parallel frame members 28 of the vehicle 20. Each of the posts 48 is L-shaped in cross section with one flange thereof engaging and welded to the associated main beam 26 and the other flange having fastener holes for being attached to the vehicle 20 frame members 28 or for being welded to the vehicle 20 frame members 28.

The assembly includes a mount comprising a pair of bearing blocks 50 disposed on the first leg cross-beam 42 for pivotally supporting a tool, the tool being a backhoe as illustrated. A tool actuator including a pair of hydraulic cylinder-pistons 52 are attached to the main cross-beam 40 for pivoting the tool about the bearing blocks 50.

Figure 2:
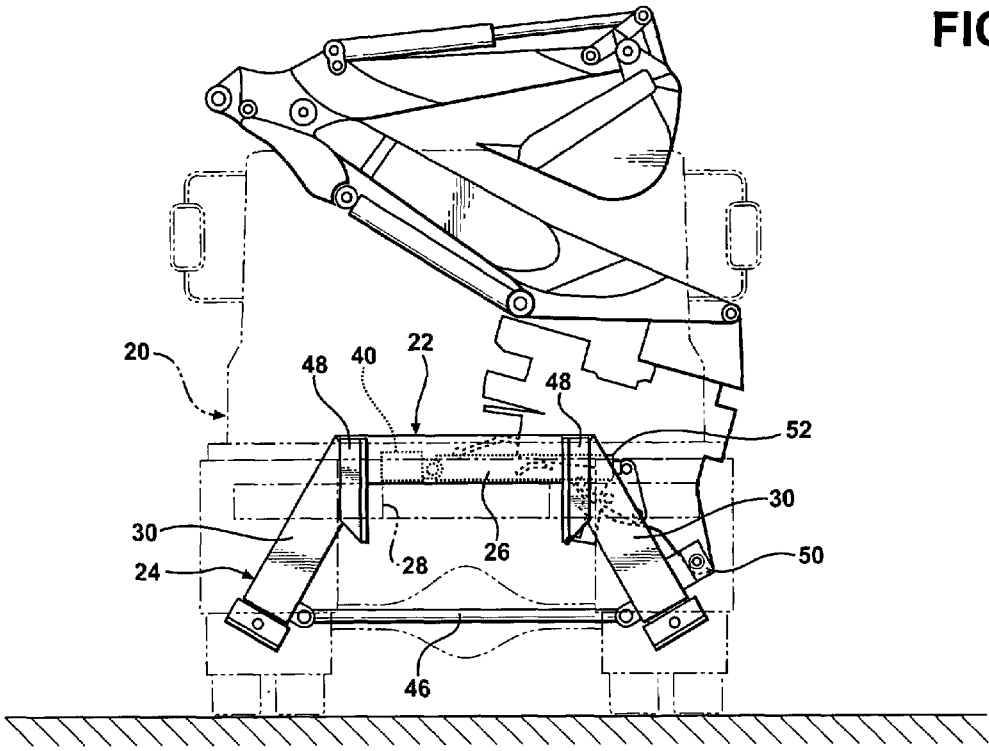
FIG. 2 is a rear view of the assembly supported on the frame members of a truck shown in phantom with the stabilizing legs retracted and a back hoe attached to the assembly and in a stored or in-operative position.
Figure 3:
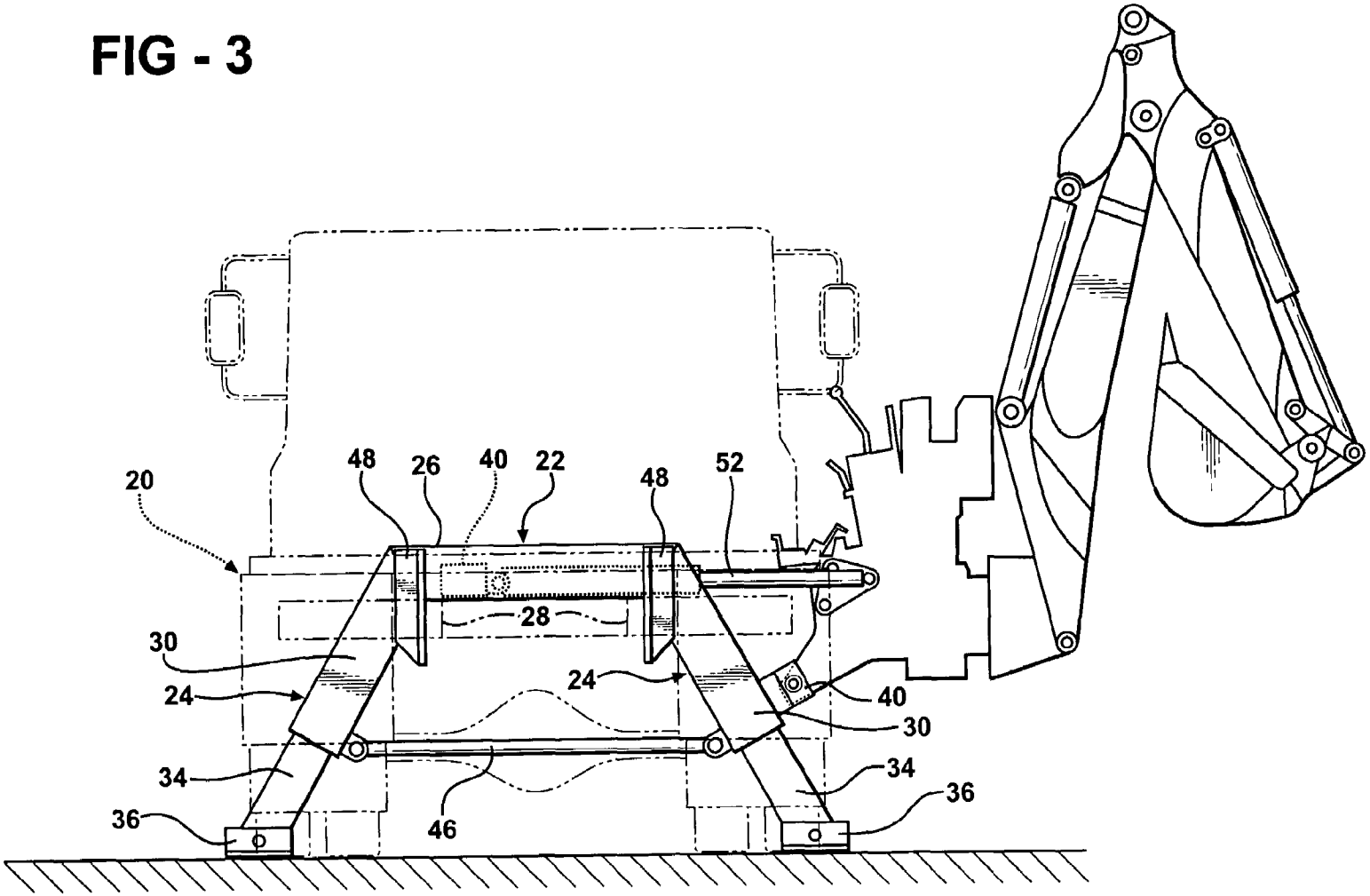
FIG. 3 is a rear view of the assembly like FIG. 2 but with the stabilizing legs extended and the back hoe in an operational mode.
Figure 4:
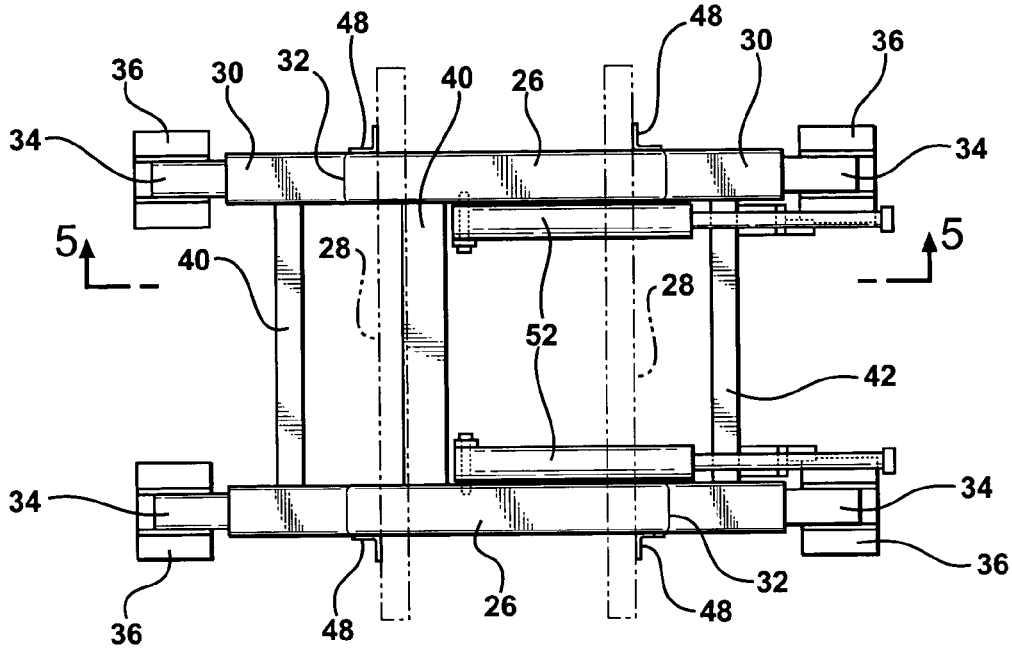
FIG. 4 is a top view of the mounting assembly.
Figure 5:
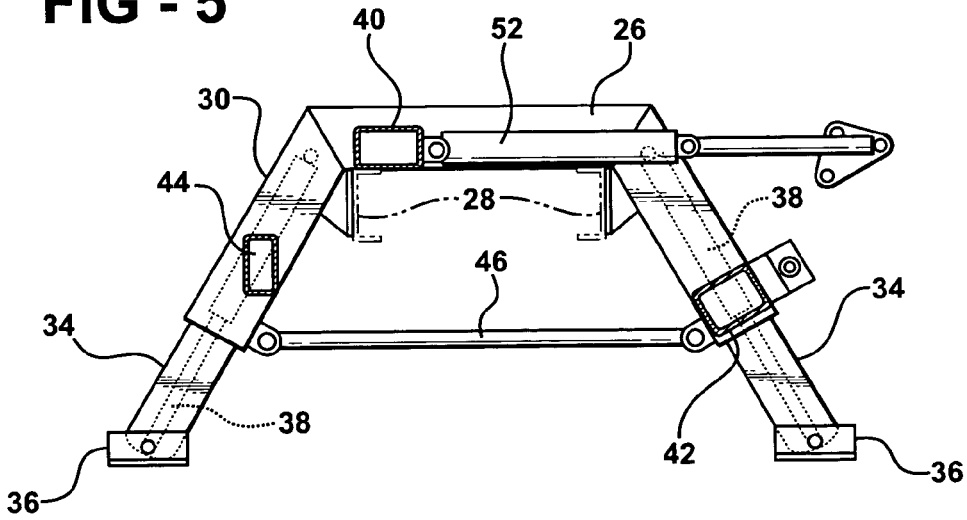
FIG. 5 is a cross sectional view taken along line 5-5 of FIG. 4.

FIG. 2 shows a backhoe mounted on the bearing blocks 50 and rotated to a transport or stored position where the pivotally interconnected arms of the backhoe overlie one another transversely of the vehicle frame members 28. Upon actuation of the cylinder pistons 52, the base of the backhoe is rotated about the bearing blocks 50 to an operational position, as shown in FIG. 3.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. An assembly for mounting various work tools to a construction vehicle (20) comprising;

a platform (22), a plurality of stabilizing legs (24) extending from said platform (22) for engaging the ground to stabilize said platform (22), a pair of parallel and spaced connectors for connecting said platform (22) at spaced positions along a pair of parallel frame members (28) of a vehicle (20), said platform (22) including a pair of main beams (26) disposed in spaced and parallel relationship to one another for extending transversely between ends and across the frame members (28) with one of said connectors disposed on each main beam (26) for attaching each main beam (26) to both of the frame members (28), said platform (22) includes a main cross-beam (40) interconnecting said main beams (26), a cross tie (46) extending between said stabilizing legs (24) at opposite ends of each of said main beams (26), one of said stabilizing legs (24) extending downwardly from each end of each of said main beams (26) with a pair of stabilizing legs (24) extending parallel to one another from opposite ends of the main beams (26), and a first leg cross-beam (42) extending transversely to and interconnecting a first pair of said stabilizing legs (24).

2. An assembly as set forth in claim 1 including a second leg cross-beam (44) extending transversely to and interconnecting a second pair of said stabilizing legs (24).

3. An assembly for mounting various work tools to a construction vehicle (20) comprising;

a platform (22), a plurality of stabilizing legs (24) extending from said platform (22) for engaging the ground to stabilize said platform (22), a pair of parallel and spaced connectors for connecting said platform (22) at spaced positions along a pair of parallel frame members (28) of a vehicle (20), said platform (22) including a pair of main beams (26) disposed in spaced and parallel relationship to one another for extending transversely between ends and across the frame members (28) with one of said connectors disposed on each main beam (26) for attaching each main beam (26) to both of the frame members (28), said platform (22) including a main cross-beam (40) interconnecting said main beams (26), one of said stabilizing legs (24) extending downwardly from each end of each of said main beams (26) with a pair of stabilizing legs (24) extending parallel to one another from opposite ends of said main beams (26), a first leg cross-beam (42) extending transversely to and interconnecting a first pair of said stabilizing legs (24), a second leg cross-beam (44) extending transversely to and interconnecting a second pair of said stabilizing legs (24), and a cross tie (46) extending between said stabilizing legs (24) at opposite ends of each of said main beams (26).

4. An assembly as set forth in claim 2 wherein said stabilizing legs (24) at opposite ends of each of said main beams (26) diverge from one another.

5. An assembly as set forth in claim 4 wherein each of said stabilizing legs (24) includes a fixed length (30) attached to an associated end of one of said main beams (26) and a telescoping length (34) slidably supported by said fixed length (30), a leg actuator (38) interconnecting each telescoping length (34) to the associated fixed length (30) for moving said telescoping lengths (34) relative to the associated fixed lengths (30), said leg cross-beam (42, 44) extending between and interconnecting said fixed lengths (30) of said second pair of said stabilizing legs (24).

6. An assembly as set forth in claim 5 wherein each of said connectors comprises a post (48) extending from said main beams (26).

7. An assembly as set forth in claim 6 wherein each of said posts (48) has an L-shaped cross section with one flange thereof engaging the associated main beam (26).

8. An assembly as set forth in claim 1 including a mount disposed on said first leg cross-beam (42) for pivotally supporting a tool.

9. An assembly as set forth in claim 8 including at least one tool actuator attached to said main cross-beam (40) for pivoting a tool about said mount.

10. An assembly for mounting various work tools to a construction vehicle (20) comprising;

a pair of main beams (26) disposed in spaced and parallel relationship to one another for extending transversely between ends and across the frame members (28) of a vehicle (20), characterized by a fixed length (30) of each stabilizing leg (24) extending downwardly from each end of each of said main beams (26) and diverging outwardly from opposite ends of said main beams (26) to define a pair of stabilizing legs (24) extending parallel to one another at opposite ends of said main beams (26), said main beams (26) and said fixed lengths (30) each comprising a hollow tube having a four sided cross section and each of said fixed lengths (30) being welded to an associated end of one of said main beams (26) at a mitred joint (32) therebetween, a telescoping length (34) of each stabilizing leg (24) slidably supported by said fixed length (30) and extending to a distal end, a leg actuator (38) connected to each telescoping length (34) and extending into the associated fixed length (30) for moving each telescoping length (34) relative to the associated fixed length (30), a foot (36) on each of said distal ends of said telescoping lengths (34) for engaging the ground to stabilize said platform (22), a main cross-beam (40) interconnecting said main beams (26) adjacent one end thereof, a first leg cross-beam (42) extending transversely to and interconnecting said fixed lengths (30) below a first end of said main beams (26), said first leg cross-beam (42) having a four sided cross section with two parallel sides thereof being disposed parallel to said fixed lengths (30) attached thereto, a pair of bearing blocks (50) disposed on said first leg cross-beam (42) for pivotally supporting a tool, a tool actuator including a pair of hydraulic cylinder-pistons (52) attached to said main cross-beam (40) for pivoting a tool about said bearing blocks (50), a second leg cross-beam (44) extending transversely to and interconnecting said fixed lengths (30) below a second end of said main beams (26), said second leg cross-beam (44) having a four sided cross section with two parallel sides thereof being disposed parallel to said sides of said main beams (26), a cross tie (46) extending between diverging fixed lengths (30) of said stabilizing legs (24) at opposite ends of each of said main beams (26), at least four posts (48) extending from said main beams (26) with one of said posts (48) disposed adjacent each of said mitred joints (32) for connecting said main beams (26) at spaced positions along a pair of parallel frame members (28) of a vehicle (20), and each of said posts (48) being L-shaped in cross section with one flange thereof welded to the associated main beam (26).

* * * * *